US012655642B2

(12) United States Patent
Pospisil

(10) Patent No.: US 12,655,642 B2
(45) Date of Patent: Jun. 16, 2026

(54) ACOUSTIC ISOLATORS

(71) Applicant: UNITED STATES GYPSUM COMPANY, Chicago, IL (US)

(72) Inventor: Frank Pospisil, Oak Park, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 136 days.

(21) Appl. No.: 18/755,409

(22) Filed: Jun. 26, 2024

(65) Prior Publication Data

US 2025/0198173 A1 Jun. 19, 2025

Related U.S. Application Data

(60) Provisional application No. 63/609,588, filed on Dec. 13, 2023.

(51) Int. Cl.
*E04F 15/20* (2006.01)

(52) U.S. Cl.
CPC ..... *E04F 15/20* (2013.01)

(58) Field of Classification Search
CPC ..... E04F 15/20; E04F 15/203; E04F 15/225; E04F 15/22
See application file for complete search history.

(56) References Cited

U.S. PATENT DOCUMENTS 1,465,383 A * 8/1923 Walsh ..... B27M 1/02 16/DIG. 18
1,693,655 A * 12/1928 Murphy ..... E04F 15/20 52/480
1,745,171 A * 1/1930 Jacques ..... E04F 15/20 52/480
2,578,781 A * 12/1951 Brundige ..... B27D 1/08 428/56
3,662,509 A * 5/1972 Studzinski ..... E04D 13/1618 52/404.1
3,811,237 A * 5/1974 Bettinger ..... E04F 15/02452 D25/119
3,857,446 A * 12/1974 Kenny ..... F16K 17/38 169/37

(Continued)

FOREIGN PATENT DOCUMENTS

EP 2871056 A1 5/2015
EP 3385463 A1 10/2018

(Continued)

OTHER PUBLICATIONS

International Search Report and Written Opinion received for PCT/US2024/058770, mailed Apr. 9, 2025.

*Primary Examiner* — Rodney Mintz
(74) *Attorney, Agent, or Firm* — Pradip Sahu; Greer, Burns & Crain, Ltd.

(57) ABSTRACT

A cement-based acoustic isolator for use in a composite flooring system which includes a Cross Laminated Timber (CLT) subfloor, a metal inverted track attached to a top surface of the cement-based acoustic isolator, and an upper flooring attached to a top surface of the metal inverted track, includes a plurality of structural panel layers stacked upon one another; and an adhesive which secures the plurality of structural panel layers to one another. The adhesive also secures the plurality of structural panel layers to the metal inverted track and the CLT subfloor of the composite flooring system.

18 Claims, 2 Drawing Sheets

(56) References Cited

U.S. PATENT DOCUMENTS 3,899,857 A * 8/1975 Mochizuki ..... E04F 15/02452 52/347
4,569,873 A * 2/1986 Robbins ..... B27N 3/06 428/106
4,589,243 A * 5/1986 Abendroth ..... E04B 1/0007 52/480
4,629,523 A 12/1986 Wetterwald et al.
4,635,424 A * 1/1987 Drapeau ..... E04F 13/0812 52/510
4,682,459 A * 7/1987 Stephenson ..... E04F 15/22 52/390
4,742,654 A * 5/1988 Cole ..... E04B 5/12 D25/138
4,831,806 A * 5/1989 Niese ..... E04F 15/186 52/391
4,879,856 A * 11/1989 Jones ..... E04F 15/20 52/489.1
4,890,434 A * 1/1990 Niese ..... E04F 15/225 52/480
4,930,280 A 6/1990 Abendroth
5,097,906 A * 3/1992 Polan ..... A62C 37/08 285/46
5,111,627 A * 5/1992 Brown ..... E04F 15/02016 52/126.5
5,277,010 A * 1/1994 Stephenson ..... E04F 15/225 52/480
5,303,526 A * 4/1994 Niese ..... E04F 15/225 52/480
5,366,022 A * 11/1994 Meyer ..... A62C 37/08 169/37
5,377,471 A * 1/1995 Niese ..... E04F 15/22 D25/138
5,388,380 A * 2/1995 Niese ..... E04F 15/22 52/480
5,452,551 A * 9/1995 Charland ..... A62C 2/065 52/220.8
5,465,548 A * 11/1995 Niese ..... E04F 15/22 29/897.3
5,513,708 A * 5/1996 Sundholm ..... A62C 99/0072 251/282
5,778,621 A * 7/1998 Randjelovic ..... E04F 15/22 52/480
5,906,082 A * 5/1999 Counihan ..... E04F 15/02194 52/480
6,055,785 A * 5/2000 Counihan ..... E04F 15/22 52/480
6,115,981 A * 9/2000 Counihan ..... E04F 15/22 52/489.1
6,162,312 A * 12/2000 Abney ..... B27M 3/0086 156/154
6,164,031 A * 12/2000 Counihan ..... E04F 15/02 52/489.1
6,363,675 B1 * 4/2002 Shelton ..... E04F 15/225 52/302.1
6,620,487 B1 9/2003 Tonyan et al.
6,698,146 B2 * 3/2004 Morgan ..... E04B 2/82 52/220.8
6,742,312 B2 * 6/2004 Valentine ..... E04F 15/225 52/480
7,017,868 B2 * 3/2006 Kirschner ..... A62C 37/08 248/327
7,093,814 B2 * 8/2006 Meisel ..... F16F 1/44 52/480
7,152,385 B2 * 12/2006 Morgan ..... E04D 13/1656 52/317
7,670,520 B2 3/2010 Dubey
7,703,252 B2 * 4/2010 Randjelovic ..... E04F 15/225 52/177
7,735,280 B2 * 6/2010 Valentine ..... F16F 1/44 52/480
7,886,488 B2 * 2/2011 Payne, Jr. ..... E04F 15/20 52/480
7,895,803 B2 * 3/2011 Downey ..... F16F 15/00 248/610
7,908,810 B2 * 3/2011 Payne, Jr. ..... E04B 5/10 52/480
8,030,377 B2 10/2011 Dubey et al.
8,038,790 B1 10/2011 Dubey et al.
8,312,691 B2 * 11/2012 Kim ..... F28D 20/0056 52/746.1
8,622,169 B2 * 1/2014 Kim ..... E04F 15/225 181/290
8,927,085 B2 * 1/2015 Burton ..... B27N 3/04 428/105
9,039,827 B2 5/2015 Hampson
9,146,038 B2 * 9/2015 Cha ..... E04B 5/48
9,151,042 B2 * 10/2015 Simon ..... A62C 2/065
9,246,315 B2 * 1/2016 Boyd ..... F16L 5/04
9,320,929 B2 * 4/2016 Koiwa ..... A62C 35/68
9,463,343 B2 * 10/2016 Koiwa ..... A62C 37/12
9,464,436 B2 * 10/2016 Malakauskas ..... E04B 1/82
9,803,379 B2 * 10/2017 Randjelovic ..... E04F 15/22
9,828,287 B2 11/2017 Swift et al.
9,890,540 B2 * 2/2018 Weitzer ..... E04F 13/077
10,131,119 B2 * 11/2018 Freres ..... B32B 37/18
10,132,079 B2 * 11/2018 Zollig ..... E04C 3/122
10,370,860 B2 8/2019 Socha
10,464,294 B2 * 11/2019 Freres ..... B32B 7/03
10,724,228 B2 * 7/2020 Collins ..... E04B 5/10
11,053,697 B2 * 7/2021 Randjelovic ..... E04F 15/22
11,054,148 B2 * 7/2021 Collins ..... E04C 2/525
11,084,245 B2 * 8/2021 Kuhn ..... B32B 1/00
11,530,540 B2 * 12/2022 Downey ..... E04F 15/082
11,686,105 B2 * 6/2023 Beyreuther ..... E04F 15/046 52/588.1
11,939,778 B2 * 3/2024 Downey ..... E04F 15/082
12,103,278 B2 * 10/2024 Mullet ..... B32B 13/12
2002/0178675 A1 * 12/2002 Valentine ..... E04F 15/225 52/480
2003/0079425 A1 * 5/2003 Morgan ..... E04B 2/7411 52/232
2004/0045234 A1 * 3/2004 Morgan ..... E04D 13/1656 52/232
2004/0117053 A1 * 6/2004 Kirschner ..... A61B 1/247 700/117
2004/0245427 A1 * 12/2004 Meisel ..... F16F 1/44 248/562
2007/0000198 A1 * 1/2007 Payne, Jr. ..... E04B 5/40 52/414
2007/0110970 A1 * 5/2007 Dubey ..... B28B 19/0092 427/180
2007/0289238 A1 * 12/2007 Payne ..... E04F 15/20 52/408
2008/0017780 A1 * 1/2008 Downey ..... F16F 1/373 248/610
2008/0104915 A1 * 5/2008 Randjelovic ..... E04F 15/225 52/779
2009/0211192 A1 * 8/2009 Valentine ..... F16F 1/44 52/480
2009/0239977 A1 * 9/2009 Dubey ..... C04B 28/04 524/5
2009/0324915 A1 * 12/2009 Swift ..... C03C 25/325 428/219
2010/0077684 A1 * 4/2010 Socha ..... B32B 5/022 52/403.1
2010/0147503 A1 * 6/2010 Kim ..... F28F 1/22 29/524.1
2011/0291441 A1 * 12/2011 Burton ..... B32B 7/04 156/331.7
2013/0008741 A1 * 1/2013 Kim ..... E04F 15/225 181/290
2013/0091789 A1 * 4/2013 Simon ..... H02G 3/22 52/220.8
2013/0306334 A1 * 11/2013 Koiwa ..... A62C 35/00 169/51
2013/0307225 A1 * 11/2013 Boyd ..... H02G 3/185 277/626
2014/0008563 A1 * 1/2014 Hampson ..... F16L 59/028 252/62

(56) References Cited

U.S. PATENT DOCUMENTS

2014/0283468 A1* 9/2014 Weitzer ..... E04F 19/00 52/390
2014/0367477 A1* 12/2014 Cha ..... E04F 15/02464 52/126.6
2015/0013240 A1* 1/2015 Malakauskas ..... E04C 2/46 52/79.9
2015/0050443 A1 2/2015 Roy et al.
2015/0083442 A1* 3/2015 Koiwa ..... A62C 35/68 169/37
2016/0145877 A1* 5/2016 Denman ..... E04F 15/203 52/741.1
2016/0258155 A1* 9/2016 Zollig ..... E04B 9/12
2017/0113442 A1* 4/2017 Freres ..... B32B 21/042
2017/0114552 A1* 4/2017 Randjelovic ..... E04B 5/43
2017/0299198 A1* 10/2017 Collins ..... E04B 5/48
2018/0250920 A1* 9/2018 Freres ..... B32B 7/12
2018/0328019 A1* 11/2018 Collins ..... E04B 1/34853
2019/0168410 A1* 6/2019 Conboy ..... E04B 1/10
2019/0169838 A1 6/2019 Conboy
2019/0169840 A1* 6/2019 Conboy ..... B32B 3/14
2019/0218795 A1 7/2019 Blomgren et al.
2020/0215784 A1* 7/2020 Kuhn ..... B32B 1/00
2021/0062520 A1* 3/2021 Beyreuther ..... E04F 15/046
2021/0115682 A1* 4/2021 Randjelovic ..... E04F 15/22
2022/0220749 A1* 7/2022 Becquet ..... B32B 5/16
2022/0339915 A1* 10/2022 Mullet ..... B32B 13/14
2022/0364373 A1* 11/2022 Downey ..... E04F 15/225
2023/0102074 A1* 3/2023 Downey ..... E04F 15/203 52/403.1
2024/0352748 A1* 10/2024 Borree ..... E04F 15/041
2024/0376711 A1* 11/2024 Pospisil ..... A62C 35/68

FOREIGN PATENT DOCUMENTS

JP H05230984 A 9/1993
JP 2003062809 A 3/2003
JP 2021173020 A 11/2021
KR 20190090105 A 8/2019
WO 2006007413 A1 1/2006

* cited by examiner

ACOUSTIC ISOLATORS

RELATED APPLICATION

The present application is a Non-Provisional of, and claims 35 USC 119 priority from, U.S. Provisional Application Ser. No. 63/609,588 filed on Dec. 13, 2023, the entire contents of which are incorporated by reference herein.

BACKGROUND

The present disclosure relates generally to acoustic isolators and more specifically acoustic isolators used in flooring systems.

Acoustic isolators have historically been used beneath reinforced concrete floors where live loads applied to the reinforced concrete floors were dispersed and supported across the thick concrete floors. The weight of the reinforced concrete floor depressed the acoustic isolators such that the addition of live loads to the reinforced concrete floors had a minimal increase in the deflection of the acoustic isolators.

Modern flooring systems are increasingly being made with Cross Laminated Timber (CLT) panels instead of reinforced concrete floors. CLT panels are prefabricated, solid engineered wood panels which are made of layered lumber boards (usually three, five, or seven) stacked crosswise at 90-degree angles and glued into place. Finger joints and structural adhesive connect the boards, which are typically between ⅝ inch to 2 inches thick. The CLT panels can be manufactured at custom dimensions, although transportation restrictions dictate their length.

With these CLT flooring systems, acoustic isolators are used in conjunction with light structural panels, such as wood panels or noncombustible panels, for example USG STRUCTO-CRETE® panels. These lighter floor membranes do not appreciably depress the acoustic floor isolators. As a result, the acoustic isolators used with CLT flooring systems deflect and move under live loads applied to the CLT floors.

Sound rated floors are typically evaluated by ASTM Standard E492 and are rated as to impact insulation class (IIC). The greater the IIC rating, the less impact noise will be transmitted to the area below. Floors may also be rated as to Sound Transmission Class (STC) per ASTM E90. The greater the STC rating, the less airborne sound will be transmitted to the area below. Sound rated floors typically are specified to have an IIC rating of not less than 50 and an STC rating of not less than 50. Many building codes require an IIC rating of 50 or higher, which is difficult to attain for buildings which utilize CLT for the subfloor. Moreover, even though an IIC rating of 50 meets many building codes, experience has shown that in luxury condominium applications, even floor-ceiling systems having an IIC of 56-57 may not be acceptable because some impact noise is still audible.

Buildings with CLT flooring systems typically will not use gypsum wallboard in the ceiling below the CLT flooring system. This is so that the wood components are exposed for aesthetic purposes. As a result, ceilings within those buildings typically do not have a plenum that aids in absorbing noise coming through the floor and ceiling assembly from above. Without the concealed space within the plenum, conventional CLT flooring systems do not include insulation which absorbs noise from the floor above.

Typically, acoustic floor isolators used with CLT flooring systems are made of materials that are soft and have low compressive strengths in order to absorb acoustic energy. Unfortunately, these soft acoustic isolators do not support live loads applied to the CLT floors and deflect as a result. Rubber based isolators, which use recycled or various virgin rubber compounds, have also been used to support an upper flooring of CLT flooring systems. However, these rubber based isolators deflect in excess of the amount allowed by the International Building Code and are expensive.

Another drawback of conventional rubber acoustic isolators is that certain building codes do not allow combustible materials in concealed spaces within the flooring/ceiling assembly. The space between a subfloor and an upper flooring of a flooring system can be interpreted as a "concealed space," meaning the acoustic isolators in those flooring systems, including CLT flooring systems, cannot be made of rubber, which is combustible.

Accordingly, there is the need for an acoustic isolator which addresses the above-listed drawbacks.

SUMMARY

The above-listed need is met or exceeded by the present acoustic isolators. For elevated flooring systems, including CLT flooring systems, where improved and code mandated IIC and STC performance is desired, gypsum, Portland or magnesium oxide based cement isolators provide low deflection and high load bearing capacities. Specifically, the present acoustic isolator includes a cement-based acoustic isolator which is made of gypsum, Portland cement or magnesium oxide that is optionally cast into a specific shape, or sheets of the materials layered to support raised acoustic floors. In the present application, "cement-based", refers to a panel or isolator made of gypsum, Portland cement, or magnesium oxide. These layers or sheets are preferably attached to one another with an adhesive. The deflection and the acoustic performance of the present cement-based acoustic isolators satisfy building code requirements and are made at a fraction the price of the rubber isolators. The cement-based acoustic isolators are reinforced with strong compressive strength materials, which provide acoustic performance, and also support heavy code mandated live loads.

The present acoustic isolators also include a reinforced acoustic isolator which includes insulation layers, preferably made of high-density fiberglass board, that provide sound dampening. Additionally, the reinforced acoustic isolator preferably is embedded with reinforcing supports such that when subject to normal everyday loading, the reinforced acoustic material of the isolator is able to support live loads. In an embodiment, the reinforced acoustic isolators include a stack of thin nonwoven reinforced fiber insulation layers which are cored or drilled into to form a hole. The hole within the stack of thin nonwoven reinforced fiber insulation layers is preferably filled with a slurry of gypsum, Portland cement or magnesium oxide. In particular, the gypsum slurry, which has increased foam once set, provides load-bearing, enhanced acoustic properties and disruption of sound transmission.

A combination of the high-density fiberglass board insulation layers and the gypsum, Portland cement or magnesium oxide provide improved acoustic performance and resistance to compressive forces. When large live loads are applied to the insulation layers, the material of the insulation layers is depressed and deflects downwards to the point where the floor panels, such as the CLT subfloor, come into contact with the reinforcing material embedded in the isolators which stops the downward deflection. The amount of downward deflection is calculated and built into the acoustic isolator, such that the deflection is within the requirements of the building code dictated deflection limits.

When the live load is removed, the isolators return to their normal height. This allows the reinforced acoustic isolators to comply with code requirements for sound reduction and floor deflection.

More specifically, a cement-based acoustic isolator for use in a composite flooring system which includes a Cross Laminated Timber (CLT) subfloor, a metal inverted track attached to a top surface of the cement-based acoustic isolator, and an upper flooring attached to a top surface of the metal inverted track, includes a plurality of structural panel layers stacked upon one another; and an adhesive which secures the plurality of structural panel layers to one another. The adhesive also secures the plurality of structural panel layers to the metal inverted track and the CLT subfloor of the composite flooring system.

In preferred embodiments, the cement-based acoustic isolator is at least 4 inches tall, the plurality of structural panel layers include a top paper sheet and a bottom paper sheet, and the cement-based acoustic isolator is in the shape of a cube or a rectangular prism.

Additionally, a composite flooring system includes a Cross Laminated Timber (CLT) subfloor, and a plurality of cement-based acoustic isolators disposed on top of and attached to the CLT subfloor. The cement-based acoustic isolators include a plurality of structural panel layers stacked upon one another; and an adhesive which secures the plurality of structural panel layers to one another. The composite flooring system also includes a plurality of metal inverted tracks attached to a top surface of the plurality of acoustic isolators; and an upper flooring attached to a top surface of the metal inverted tracks.

In preferred embodiments, the cement-based acoustic isolators are at least 4 inches tall, the plurality of structural panel layers comprise a top paper sheet and a bottom paper sheet, and the cement-based acoustic isolators are in the shape of a cube or a rectangular prism. Preferably, the CLT subfloor includes five layers of CLT panels, such that successive layers are stacked in a perpendicular orientation, and the upper flooring includes two layers of structural panels stacked in a perpendicular orientation or in a parallel orientation with staggered joints between the layers of structural panels.

In yet another preferred embodiment, the two layers of structural panels are attached with an adhesive or a combination of the adhesive and fasteners. In an alternate preferred embodiment, the upper flooring includes a layer of structural panels with a poured underlayment above the layer of structural panels. Preferably, the upper flooring includes a sound mat disposed between the layer of structural panels and the poured underlayment.

Preferably, the cement-based acoustic isolators are spaced 24 inches apart, and a space between the CLT subfloor and the top gypsum layer is filled with insulation.

Moreover, a reinforced cement-based acoustic isolator used in a flooring system includes a stack with a plurality of insulation layers secured to one another with an adhesive. The stack includes a hole, such that a cement product fills the hole. In preferred embodiments, the plurality of insulation layers includes high-density non-woven fiberglass boards, the cement product includes gypsum poured to fill the hole, and the hole is drilled into the stack of insulation layers secured to one another with the adhesive.

DETAILED DESCRIPTION

Figure 1A:
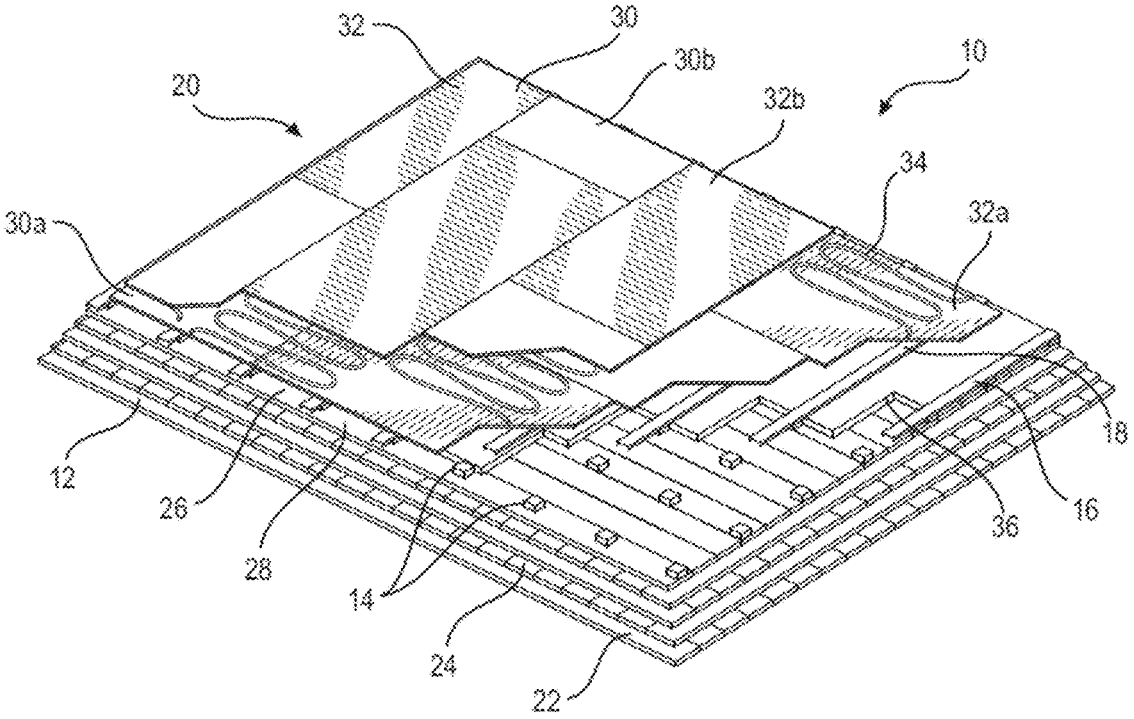
FIG. 1A is a top fragmentary perspective view of an embodiment of the present Cross Laminated Timber (CLT) flooring system which includes a plurality of acoustic isolators.
Figure 1B:
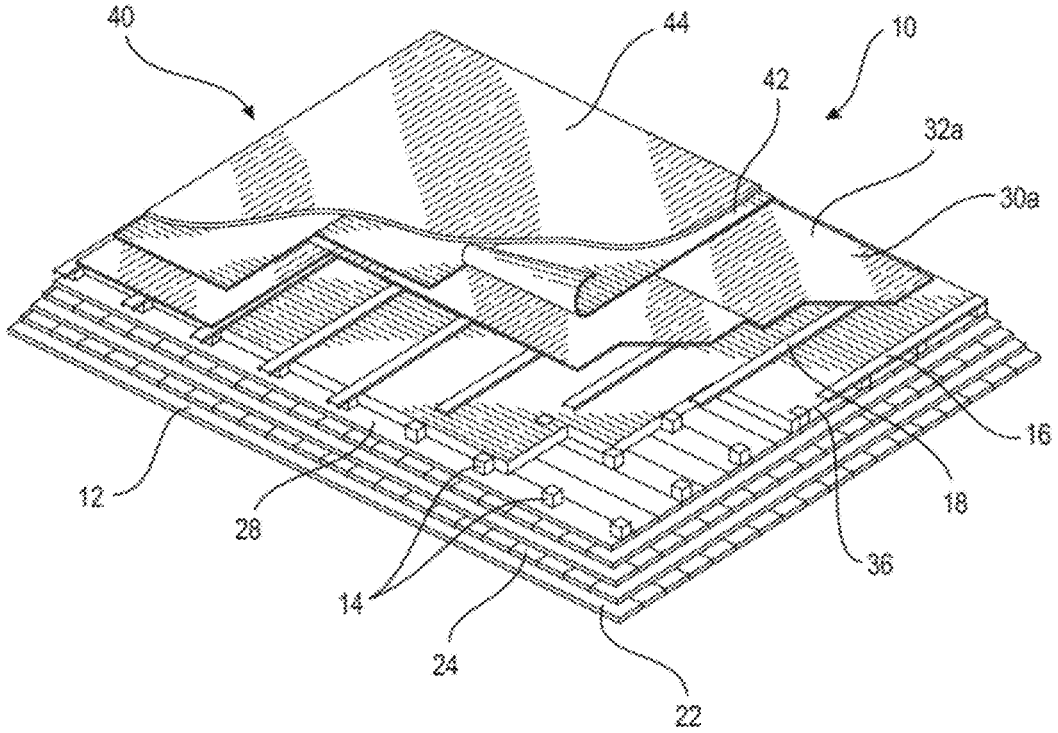
FIG. 1B is a top fragmentary perspective view of a second embodiment of the present CLT flooring system which includes a plurality of acoustic isolators.

Referring now to FIGS. 1A and 1B, in which the components are shown schematically and not to scale, a Cross Laminated Timber (CLT) flooring system is generally designated 10 and includes a subfloor 12 with a plurality of acoustic isolators 14 disposed on top of the subfloor. While the present acoustic isolators 14 are depicted within a flooring system, it is also contemplated that the acoustic isolators are optionally used in a wall system as is known in the art.

Conventionally, subfloors have been made with materials such as poured concrete or at least one layer of plywood as is known in the art. However, more recently, CLT has emerged as a popular material for use in subfloors. Specifically, CLT provides desirable mechanical properties, while being more cost effective than other conventional subfloor materials. As is known in the art, the subfloor 12 is optionally self-supporting between beams or is supported by joists (not shown) typically made of wood, steel, or concrete.

Additionally, a plurality of metal inverted "U"-tracks 16, each having a top surface 18, are attached to the plurality of acoustic isolators 14. An upper flooring 20 is secured to the top surface 18 of the inverted metal tracks 16.

The subfloor 12 has a plurality of layers 22 which preferably include CLT panels 24. In a preferred embodiment, each of the layers 22 is arranged such that the CLT panels 24 are oriented perpendicularly with respect to the CLT panels located on the layer immediately above or below. Preferably, the subfloor 12 includes between three and seven layers 22 of CLT panels 24, with five layers being the most preferred.

Additionally, a top layer 26 of the subfloor 12 includes an upper surface 28 upon which the plurality of acoustic isolators 14 are disposed. The upper flooring 20 includes at least one structural panel layer 30 which is preferably made of a plurality of structural panels 32. A "structural" panel, as used herein, is capable of supporting its own weight without visible sagging, bending, or collapsing when supported only at the edges of the panel as in a floor and ceiling assembly.

In an embodiment, the structural panels 32 are not conventional gypsum wallboard, but are of the fiber-reinforced cement board type sold by United States Gypsum Co. (USG) as Structural Panel Concrete Subfloor, also sold under the trademark STRUCTO-CRETE® panels. Alternatively, the structural panels 32 are made of conventional gypsum wallboard panels. Preferably, the structural panels 32 are at least 0.5 inch tall.

Various types of panels are optionally used as the structural panels 32. The structural panels 32 are optionally fiber reinforced Portland cement panels, magnesium oxide cement panels, wood panels such as plywood or OSB covered with a noncombustible gypsum topping, cast Portland cement or Portland cement panels, gypsum cement concrete tiles, or other structural panels as are known in the art. Specifically, gypsum slurry with increased foam, and larger bubbles, provides enhanced acoustic properties and superior disruption of sound transmission.

For example, U.S. Pat. No. 8,038,790 to Dubey et al., incorporated herein by reference, discloses cement panels able to resist lateral forces imposed by high wind and earthquake. The principal starting materials used to make the cement panels are inorganic binder, e.g., calcium sulfate alpha hemihydrate, hydraulic cement, and pozzolanic materials, lightweight filler coated expanded perlite and optional additional, ceramic microspheres or glass microspheres, as well as superplasticizer, e.g., polynapthalene sulphonates and/or polyacrylates, water, and optional additives.

Further, U.S. Pat. No. 6,620,487 to Tonyan et al., incorporated herein by reference, discloses a reinforced, lightweight, dimensionally stable panel capable of resisting shear, uniform, and concentrated loads when fastened to framing equal to or exceeding shear, uniform, and concentrated loads provided by plywood or oriented strand board panels. It is contemplated that the structural panels 32 optionally include cement panels made according to each of the preceding patents incorporated by reference.

Various methods are optionally employed to make the structural panels 32. For example, U.S. Pat. No. 7,670,520 to Dubey et al., incorporated by reference, discloses a process for producing fiber-reinforced structural cementitious panels made of at least one layer of fiber reinforced cementitious slurry, the process for each such layer of slurry including providing a moving web; depositing a first layer of individual, loose fibers upon the web; depositing a layer of settable slurry upon the deposited first layer of individual, loose fibers; depositing a second layer of individual, loose fibers upon the deposited layer of settable slurry; and actively embedding both layers of individual, loose fibers into the layer of slurry to distribute the fibers throughout the slurry.

Referring to FIG. 1A, in a preferred embodiment, the upper flooring 20 includes a bottom structural panel layer 30*a* and a top structural panel layer 30*b* where the structural panels 32*a* of the bottom structural panel layer are oriented perpendicularly to the structural panels 32*b* of the top structural panel layer. Alternatively, a parallel orientation of the top structural panels 32*b* and the bottom structural panels 32*a* is also possible provided the joints of the top structural layer 30*b* are staggered when compared to the bottom structural layer 30*a*.

The bottom structural panels 32*a* are attached to the upper surface 18 of the inverted metal tracks 16 by either fasteners, an adhesive 34 or a combination of fasteners and the adhesive. In an embodiment, the bottom structural panels 32*a* are attached to the inverted metal tracks 16 with fasteners such as screws, nails, or other fasteners as are known in the art. Alternatively, a combination of the adhesive 34 and fasteners are used to attach the bottom structural panels 32*a* to the inverted metal tracks 16, such that the fasteners are either removed once the adhesive sets or remain after the adhesive has set.

Similarly, the adhesive 34 is preferably used to attach the bottom structural panel layer 30*a* to the top structural panel layer 30*b*. In a preferred embodiment, a combination of the adhesive 34 and fasteners are used to attach the top structural panels 32*b* to the bottom structural panels 32*a*, such that the fasteners secure the top structural panels to the bottom structural panels and the inverted metal track 16 and are either removed once the adhesive sets or remain after the adhesive has set. Optionally, the top structural panels 32*b* are secured only to the bottom structural panels 32*a* and are optionally secured only by fasteners. A preferred, but non-limiting adhesive is LiquidNails® adhesive.

Preferably, the space around the acoustic isolators 14 includes insulation 36 which may be foam, fiberglass or the like, as is known in the art.

Referring to FIG. 1B, an alternate preferred embodiment of the flooring system 10 includes an alternate upper flooring 40 which includes the bottom structural panel layer 30*a* with the bottom structural panels 32*a* but omits the top structural panel layer 30*b*. Instead of the top structural panel layer 30*b*, the upper flooring 40 includes a sound mat 42 placed on top of the bottom structural panels 32*a*, and a floor underlayment 44 poured onto the sound mat 42. The adhesive 34 is optionally used to secure the sound mat 42 to the bottom structural panels 32*a*. It is also contemplated that the upper flooring 40 omits the sound mat 42, such that the floor underlayment 44 is poured onto the bottom structural panels 32*a*.

A preferred sound mat 42 is Levelrock® SAM-N25 Sound Attenuation Mat sold by USG, and a preferred underlayment is one inch Levelrock® 2500 Floor Underlayment sold by USG.

Figure 2:
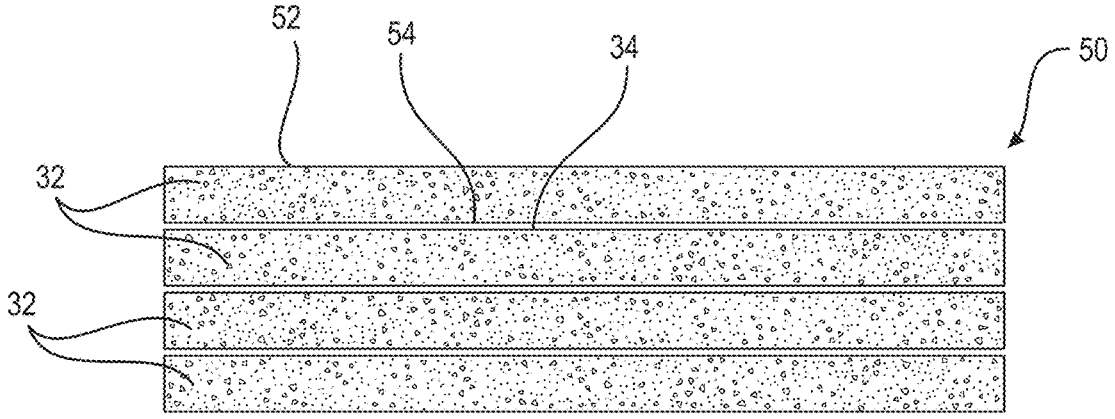
FIG. 2 is a schematic of a cement-based acoustic isolator of the present acoustic isolators.

Referring now to FIG. 2, a first embodiment of the acoustic isolator 14 is a cement-based acoustic isolator 50 which preferably includes multiple layers of the structural panels 32 stacked upon on another. "Cement-based" panel, as used herein, refers to a panel made of gypsum, Portland cement, or magnesium oxide.

While the cement-based acoustic isolator 50 depicted in FIG. 2 includes four layers of the structural panels 32, it is understood that any number of the structural panel layers are optionally used in the cement-based acoustic isolator. Each of the layers of the structural panels 32 preferably includes a top paper cover sheet 52 and a bottom paper cover sheet 54. In a preferred embodiment, layers of the structural panels 32 are secured to one another with the adhesive 34. It is also contemplated that the cement-based acoustic isolator 50 is made of gypsum, Portland cement, or magnesium oxide which is cast into various shapes, such as a cube or a rectangular prism, to form the cement-based acoustic isolator.

Preferably, the cement-based acoustic isolator 50 is formed as a cube that is at least two inches tall, and preferably still at least four inches tall, as is known in the art. In a preferred embodiment of the CLT flooring system 10, the cement-based acoustic isolators 50 are each spaced twenty-four inches away from the nearest cement-based acoustic isolator, and the cement-based acoustic isolators are evenly spaced upon the top layer 26.

In an embodiment, the cement-based acoustic isolators 50 are made with structural panels 32 that include cement imbedded with fibers, such as ⅝ inch USG Sheetrock® Brand Firecode® X Panels. Alternatively, the cement-based acoustic isolator 50 is optionally made of gypsum wallboard panels. A cement-based acoustic isolator 50 made with gypsum wallboard panels was tested to measure compressive strength and sound dampening properties. The test demonstrated that the cement-based acoustic isolator 50 provides superior resistance to deflection than current rubber based acoustic isolators, while still providing sufficient acoustic dampening to satisfy building requirements.

Figure 3:
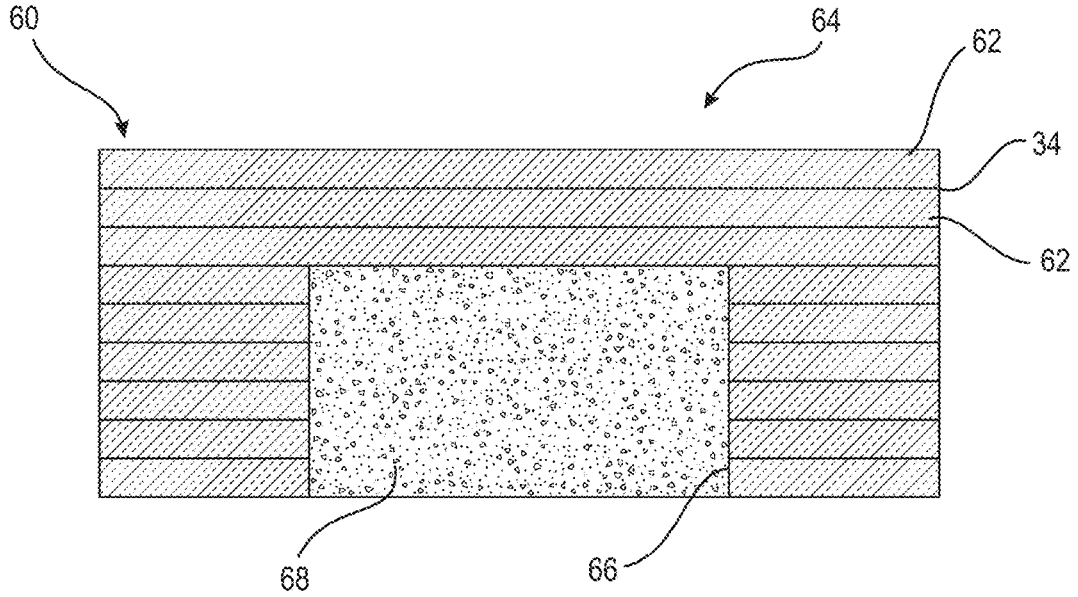
FIG. 3 is a schematic of a reinforced acoustic isolator of the present acoustic isolators.

Referring now to FIG. 3, a second embodiment of the acoustic isolators includes a reinforced acoustic isolator which is generally designated 60. The reinforced acoustic isolator 60 includes a plurality of insulation layers 62, which are preferably made of high-density fiberglass board, and preferably include non-woven fiberglass. A preferred insulation layer 62 is the Black Acoustical Board with ECOSE® Technology sold by Knauf Insulation. The adhesive 34 is preferably used to attach the insulation layers 62 to one another. Preferably, the reinforced acoustic isolator 60 is formed as a cube or a rectangular prism that is at least two inches tall, and preferably still at least four inches tall, as is known in the art.

U.S. Pat. No. 9,828,287 to Swift et al., incorporated herein by reference, discloses an insulation board which is a thermal and acoustical insulation product that includes glass fibers that are preformed into boards and bonded with a thermoset binder. Swift also discloses applying a binder to glass fibers as they are being produced, forming the binder and fiberglass into a mat, volatizing water from the binder, and heating the high-solids binder-coated fibrous glass mat to cure the binder to thereby produce a finished fibrous glass bat which may be used, for example, as a thermal or acoustical insulation product, a reinforcement for a subsequently produced composite, etc.

Further, U.S. Pat. No. 9,039,827 to Hampson, incorporated herein by reference, discloses a finished mineral fiber thermal insulation material which includes a collection of non-woven mineral fibers maintained together by a cured, substantially water insoluble, substantially formaldehyde-free, nitrogenous polymer-containing binder. It is contemplated that the insulation layers 52 is optionally made according to each of the preceding patents incorporated by reference.

While FIG. 3 shows nine insulation layers 62, it is contemplated that greater or fewer insulation layers are optionally included in the reinforced acoustic isolators 60. The plurality of insulation layers 62 form an insulation layer stack 64 which is used as a base of the reinforced acoustic isolators 60.

The insulation layer stack 64 is preferably drilled with a vertical counterbore to form a hole 66 in the bottom of the insulation layer stack. It is preferred that the hole 66 does not pass entirely through the insulation layer stack 64. The hole 66 is filled with a cement product 68 which preferably includes one of gypsum, Portland cement, or magnesium oxide. It is contemplated that the cement product 68 is poured into the hole 66 directly or is poured into a mold with a shape matching the hole 66 and inserted into the hole in the insulation layer stack 64. Alternatively, a stack of structural panels 32, which are attached to one another with the adhesive 34, are optionally used as the cement product 68, as is known in the art.

The reinforced acoustic isolators 60 provided improved resistance to compression compared to typical acoustic isolators. Specifically, the cement product 68 provides structural support to the reinforced cement-based acoustic isolators 60. When large live loads are applied to the reinforced acoustic isolators 60, the insulation layers 62 are only able to deflect to the point of the cement product 68. The amount of downward deflection of the reinforced acoustic isolators 60 is calculated and built into the reinforced acoustic isolator, such that the deflection is within the requirements of the building code dictated deflection limits. When the loading is removed from the upper flooring 20, the insulation layers 62 above the cement product 68 return to their normal height.

While a particular embodiment of the present acoustic isolators has been described herein, it will be appreciated by those skilled in the art that changes and modifications may be made thereto without departing from the invention in its broader aspects and as set forth in the following claims.

The invention claimed is:

1. A reinforced cement-based acoustic isolator used in a composite flooring system comprising:

a stack comprising a plurality of insulation layers composed of high-density non-woven fiberglass boards secured to one another with an adhesive, said stack comprising a hole penetrating therethrough; and a cement product which fills said hole, said cement product comprising gypsum poured to fill said hole.

2. The acoustic isolator of claim 1, wherein said composite flooring system includes a cross-laminated timber (CLT) subfloor, a metal inverted track attached to a top surface of said acoustic isolator, and an upper flooring attached to a top surface of said metal inverted track.

3. The acoustic isolator of claim 1, wherein said acoustic isolator is about 2 inches to about 4 inches tall.

4. The acoustic isolator of claim 1, wherein said plurality of insulation layers further comprise a top paper sheet and a bottom paper sheet.

5. The acoustic isolator of claim 1, wherein said acoustic isolator is cube-shaped or a rectangular prism shape.

6. A composite flooring system comprising:

a cross-laminated timber (CLT) subfloor;

a plurality of reinforced cement-based acoustic isolators disposed on top of and attached to said CLT subfloor, said reinforced cement-based acoustic isolators comprising:

a stack comprising a plurality of insulation layers secured to one another with an adhesive, said stack comprising a hole penetrating therethrough; and a cement product which fills said hole;

a plurality of metal inverted tracks attached to a top surface of said plurality of acoustic isolators; and an upper flooring attached to a top surface of said metal inverted tracks.

7. The composite flooring system of claim 6, wherein said reinforced cement-based acoustic isolators are about 2 inches to about 4 inches tall.

8. The composite flooring system of claim 6, wherein said plurality of insulation layers further comprise a top paper sheet and a bottom paper sheet.

9. The composite flooring system of claim 6, wherein said reinforced cement-based acoustic isolators are cube-shaped or a rectangular prism shape.

10. The composite flooring system of claim 6, wherein said CLT subfloor comprises five layers of CLT panels, such that successive layers are stacked in a perpendicular orientation.

11. The composite flooring system of claim 6, wherein said reinforced cement-based acoustic isolators are spaced 24 inches apart.

12. The composite flooring system of claim 6, wherein a space between said CLT subfloor and a top gypsum layer is filled with insulation.

13. The composite flooring system of claim 6, wherein said plurality of insulation layers comprises high-density non-woven fiberglass boards.

14. The composite flooring system of claim 6, wherein said cement product comprises gypsum poured to fill said hole.

15. The composite flooring system of claim 6, wherein said upper flooring comprises two layers of structural panels stacked in a perpendicular orientation or in a parallel orientation with staggered joints between said two layers of structural panels.

16. The composite flooring system of claim 15, wherein said two layers of structural panels are attached with panel adhesive or a combination of the panel adhesive and fasteners.

17. The composite flooring system of claim 6, wherein said upper flooring comprises a layer of structural panels with a poured underlayment above said layer of structural panels.

18. The composite flooring system of claim 17, wherein said upper flooring comprises a sound mat disposed between said layer of structural panels and said poured underlayment.

* * * * *